US007967051B2

(12) United States Patent
Diaz

(10) Patent No.: US 7,967,051 B2
(45) Date of Patent: Jun. 28, 2011

(54) COUNTERBALANCE SYSTEM FOR UPWARD ACTING DOOR

(75) Inventor: Juan M. Diaz, Plano, TX (US)

(73) Assignee: Overhead Door Corporation, Lewisville, TX (US)

( * ) Notice: Subject to any disclaimer, the term of this patent is extended or adjusted under 35 U.S.C. 154(b) by 553 days.

(21) Appl. No.: 11/707,365

(22) Filed: Feb. 16, 2007

(65) Prior Publication Data

US 2008/0196844 A1 Aug. 21, 2008

(51) Int. Cl.

| | |
|---|---|
| ***E05F 11/00*** | (2006.01) |
| ***E05F 13/00*** | (2006.01) |
| ***E05F 15/00*** | (2006.01) |
| ***E05D 15/00*** | (2006.01) |

(52) U.S. Cl. ..... 160/188; 160/191; 160/192; 160/193; 160/201

(58) Field of Classification Search ..... 160/191, 160/192, 193, 201, 313, 318, 317; 16/197; 49/200, 199, 197

See application file for complete search history.

(56) References Cited

U.S. PATENT DOCUMENTS

| | | | | | |
|---|---|---|---|---|---|
| 260,045 | A | * | 6/1882 | Osgood | 160/313 |
| 736,333 | A | * | 8/1903 | Meyer | 267/155 |
| 748,641 | A | | 1/1904 | Newell | |
| 1,965,478 | A | | 7/1934 | Smith | |
| 1,992,006 | A | | 2/1935 | Greegor | |
| 2,006,228 | A | | 6/1935 | Collins | |
| 2,314,015 | A | | 3/1943 | Parsons | |
| 2,350,286 | A | | 5/1944 | Mitchelman | |
| 2,630,597 | A | | 3/1953 | Robinson | |
| 2,660,753 | A | | 12/1953 | Moler | |
| 2,674,306 | A | * | 4/1954 | Prieto | 160/313 |
| 2,765,843 | A | | 10/1956 | Nilles | |
| 2,786,231 | A | * | 3/1957 | Robinson | 16/197 |
| 2,842,198 | A | * | 7/1958 | Prieto | 160/313 |
| 3,448,943 | A | | 6/1969 | Herou | |
| 4,731,905 | A | | 3/1988 | Milano et al. | |
| 4,940,357 | A | * | 7/1990 | Davis | 403/344 |
| 5,239,777 | A | | 8/1993 | Husselton | |
| 5,464,197 | A | * | 11/1995 | Ecclesfield | 267/155 |
| 5,694,664 | A | | 12/1997 | Newton et al. | |
| 5,996,670 | A | | 12/1999 | Igarashi | |
| 6,115,884 | A | | 9/2000 | DeJong et al. | |
| 6,122,862 | A | | 9/2000 | Hormann | |
| 6,123,140 | A | | 9/2000 | Bergamaschi | |
| 6,125,907 | A | | 10/2000 | Tokuyama et al. | |
| 6,230,785 | B1 | | 5/2001 | Tokuyama et al. | |
| 6,327,744 | B1 | | 12/2001 | Dorma | |
| 6,408,625 | B1 | | 6/2002 | Woon et al. | |
| 6,408,925 | B1 | | 6/2002 | Dorma | |
| 6,615,897 | B2 | | 9/2003 | Dorma | |
| 6,735,905 | B1 | | 5/2004 | Miller | |
| 6,986,508 | B2 | | 1/2006 | Alers et al. | |
| 7,237,592 | B2 | | 7/2007 | Arnoux et al. | |
| 7,441,372 | B2 | | 10/2008 | Bortoluzzi | |
| 2005/0092447 | A1 | * | 5/2005 | Mock | 160/201 |
| 2008/0073039 | A1 | | 3/2008 | Gyngell et al. | |

* cited by examiner

*Primary Examiner* — Katherine Mitchell
*Assistant Examiner* — Jaime F Cardenas-Garcia
(74) *Attorney, Agent, or Firm* — Kenneth R. Glaser; Gardere Wynne & Sewell LLP

(57) ABSTRACT

A torsion coil spring type counterbalance system for an upward acting door includes one or more sleeves disposed over or within the spring coils and engageable with a predetermined number of spring coils during operation of the spring to modify the spring rate to more closely approximate the required counterbalance forces exertable on the door when the door moves between open and closed positions. The counterbalance system is particularly advantageous for upward acting sectional doors which have one or more sections which are heavier than the other sections, including an uppermost section which may be heavier due to the provision of windows or other structural features of the section.

14 Claims, 7 Drawing Sheets

COUNTERBALANCE SYSTEM FOR UPWARD ACTING DOOR

BACKGROUND OF THE INVENTION

Multi-section and so called rollup type upward acting garage doors are ubiquitous. A longstanding problem in the design and production of upward acting sectional type garage doors is the provision of a suitable counterbalance system for counterbalancing the weight of the door when it moves between open and closed positions. Ideally, a motorized operator or a human user of the door should be required to exert very little force when moving the door between open and closed positions. To this end, historically, upward acting sectional doors have been provided with counterbalance mechanisms comprising, typically, torsion coil springs operably engaged with an elongated shaft mounted generally above the door. Spaced apart cable drums are mounted on opposite ends of the shaft and are connected to the door at the lowermost section by elongated flexible cables which are wound onto and off of the drums as the door is moved between open an closed positions. Counterbalance forces are provided by adjusting the torsional windup of the torsion spring or springs. Generally, a sectional door wherein the section weights are similar can be substantially counterbalanced by a conventional torsion spring counterbalance mechanism as described hereinabove and well known to those skilled in the art.

However, sectional garage doors may be subjected to many modified design features, including relatively thick or heavy glass windows, ornamental features and additional structural or reinforcing components which have resulted in sectional doors wherein the respective door sections are of unequal weight. Whenever the weights of the door sections are not essentially equal, the effective door weight as the door travels between open and close positions is difficult to counterbalance by using conventional torsion spring counterbalance mechanisms.

Still another problem associated with counterbalancing upward acting doors is found with so-called rollup type or curtain type doors which are rolled onto and off of a rotatable drum between open and closed positions. Counterbalancing the door-closed weight of a rollup door with a conventional torsion coil spring counterbalance mechanism will result in insufficient counterbalancing of the door weight in a partially open position of the door, namely, from about a 10% door open position to a 70% door open position, and the counterbalance torque will exceed the torque required to rotate the drum when the door is essentially fully open. Moreover, if a conventional counterbalance spring arrangement is sized to counterbalance the weight of the door in the mid-range of movement of the door between open and closed positions, the counterbalance torque exerted by the spring will be substantially in excess of that which is needed when the door is fully closed or fully open.

Accordingly, the present invention is directed to an improved counterbalance system and method of counterbalancing sectional doors, as well as so called rollup type doors, which overcomes the problems associated with counterbalancing doors having sections or portions thereof which are of different weights.

SUMMARY OF THE INVENTION

The present invention provides an improved counterbalance system for an upward acting door. The present invention also provides, in particular, an improved counterbalance system and method for counterbalancing sectional upward acting doors as well as so called rollup type upward acting doors.

In accordance with one important aspect of the present invention, a door counterbalance system is provided for use with sectional doors, as well as rollup type doors, wherein a torsion spring counterbalance mechanism is provided with means for varying the effective spring rate and the resultant torque exerted by the counterbalance mechanism as the door moves between open and closed positions. In this way, a dramatic change in the effective weight of the door tending to move the door in one direction or the other is more effectively counterbalanced than may be accomplished with conventional torsion coil spring counterbalance mechanisms.

The aforementioned so-called dual or variable rate torsion spring mechanism is provided by engaging several of the spring coils with a generally cylindrical sleeve to effectively cause the coils to become inactive. The sleeve length is less than the total active length of the spring and may have an outside diameter that is smaller than the spring inside diameter in a spring relaxed condition. However, the sleeve outside diameter is provided to be larger than the torsion spring inside diameter when the spring is at least partially wound or at maximum torque, such as when the door is in a substantially closed position. The sleeve or sleeves may be disposed over the counterbalance shaft and, of course, of a larger diameter than the shaft diameter. The sleeve or sleeves may be disposed at any axial position with respect to the active coils of the torsion spring.

The outside diameter or external surface geometry of the sleeve may not be required to be cylindrical but may be of any geometry that prevents the torsion spring coils from being active, that is, coils which cannot be further elastically wound or decrease in diameter, for example.

In accordance with another aspect of the present invention, multiple internal sleeves, that is, sleeves which are disposed within the inside diameter of a torsion coil spring, may be used to generate a multi-rate torsion spring. If more than one sleeve is used to modify the spring rate, each sleeve may have a different outside diameter so that certain coils become active or inactive as the spring is unwound or wound tighter in operation. Still further, a single sleeve with either an increasing or decreasing outside diameter or stepped diameters may also be used to provide a multi-rate torsion spring.

In accordance with a further aspect of the present invention an improved counterbalance system for an upward acting door is provided wherein a torsion coil spring counterbalance mechanism is provided with a so-called external sleeve, or sleeves, which may be installed over the outside diameter of the coil spring and have an inside diameter which is greater than the torsion spring outside diameter at a maximum torque or a maximum turns condition of the torsion coil spring, but engageable with spring coils as they unwind or increase in diameter. The external sleeve is shorter than the effective active length of the torsion spring. Multiple external sleeves may be provided with each sleeve having a different inside diameter for engaging and inactivating spring coils at various operating conditions of the spring as it winds or unwinds in use. Again, a single external sleeve with a variable inside diameter or stepped diameters may also be utilized to generate a multi-rate torsion spring.

The present invention is operable with so-called rollup and so-called one piece or "California" type doors as well as conventional sectional upward acting doors. Those skilled in the art will further appreciate the advantages and superior features of the invention upon reading the detailed description which follows in conjunction with the drawings.

DETAILED DESCRIPTION OF THE PREFERRED EMBODIMENTS

Figure 1:
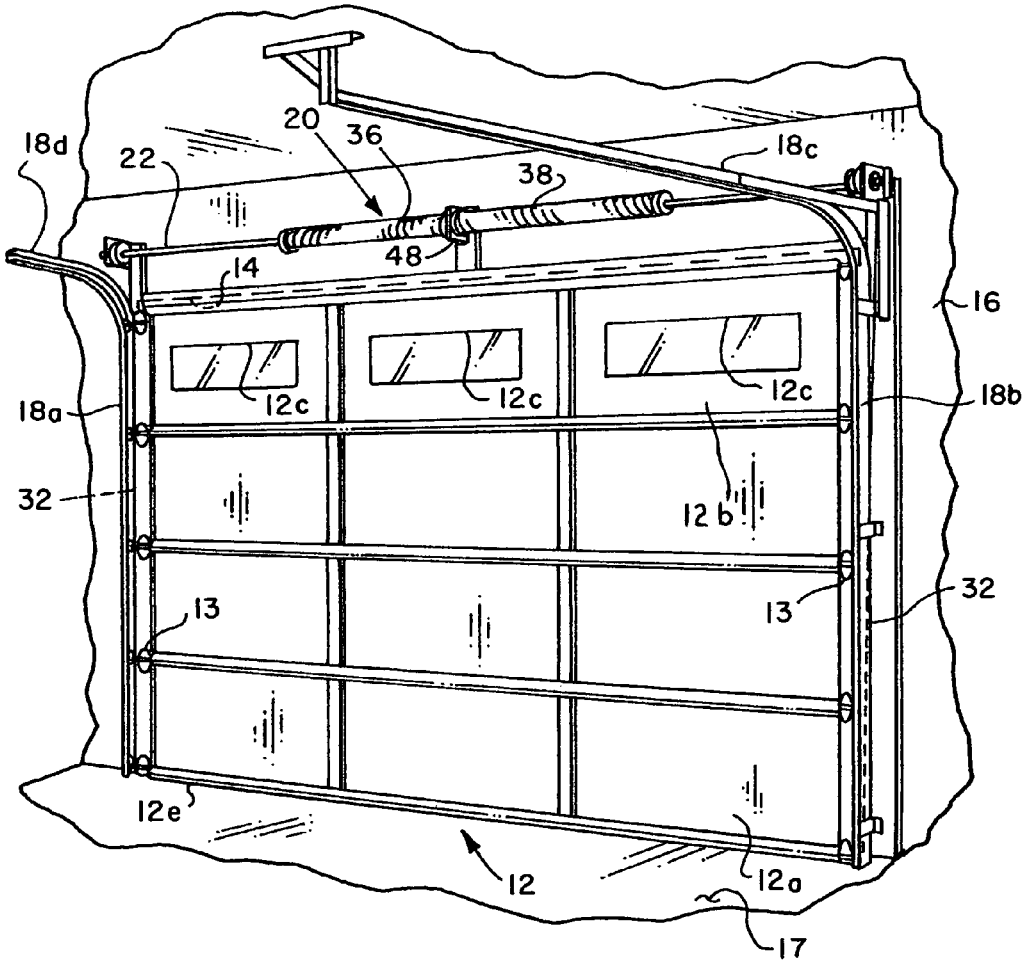
FIG. 1 is a perspective view of a sectional upward acting door including a torsion spring counterbalance system in accordance with the present invention.

In the description which follows like parts are marked throughout the specification and drawings with the same reference numerals, respectively. The drawing figures may not be to scale and certain features may be shown exaggerated in scale or in somewhat schematic form in the interest of clarity and conciseness.

Referring to FIG. 1, there is illustrated a sectional upward acting garage door 12 covering an opening 14 in a vertical wall 16, which opening extends to a floor 17. The sectional door 12 may be of conventional construction and of a type manufactured by the assignee of the present invention in various configurations. A typical sectional upward acting door, such as the door 12, is made up of multiple sections 12*a* and 12*b* which are interconnected by suitable hinges 13. The door 12 is guided for movement between the closed position shown and an open position on spaced apart guide tracks 18*a* and 18*b* which each include substantially vertical leg portions and horizontal leg portions 18*c* and 18*d*, respectively, and interconnected by curvilinear portions in a conventional manner. One preferred configuration of guide tracks is that disclosed in U.S. Pat. Nos. 6,527,035 and 6,554,047, both assigned to the assignee of the present invention. The door 12 may also be operably connected to a motorized operator, not shown, for moving the door between open and closed positions.

The door sections 12*a* and 12*b* may be of unequal weight. For example, the uppermost section 12*b* of the door 12 is shown to include multiple windows 12*c* which modify or increase the weight of the section 12*b* versus the three remaining sections 12*a*. Accordingly, when the door 12 moves between open and closed positions, the effective force acting to close the door, for example, will vary and this variation will be different and more severe for doors which have sections of unequal weight. Historically, sectional doors of uneven weight have been modified by, for example, adding weight to the lowermost section 12*a* to compensate for added weight of an uppermost section 12*b*. However, this form of modification uses additional material and labor and the added weight may require the use of a more powerful and more expensive motorized operator, for example.

Figure 2:
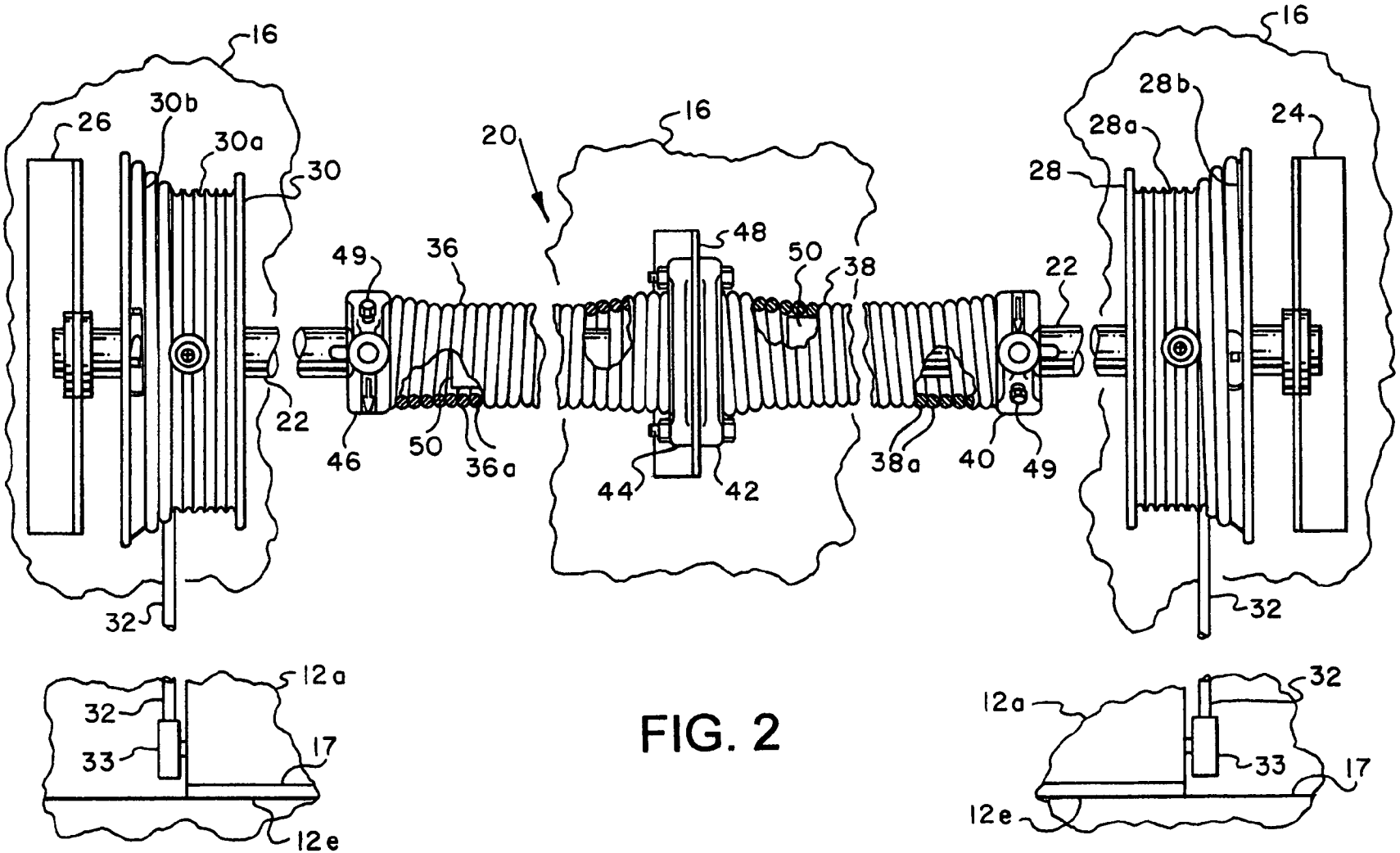
FIG. 2 is a detail view of the counterbalance system for the door illustrated in FIG. 1.

Referring further to FIG. 1 and also FIG. 2, the sectional door 12 includes a counterbalance mechanism, generally designated by the numeral 20, comprising an elongated shaft 22 supported for rotation between spaced apart support brackets 24 and 26, see FIG. 2. Brackets 24 and 26 may be of the type disclosed in the above-mentioned patents assigned to the assignee of this invention and are suitably mounted on wall 16 for supporting the shaft 22. Shaft 22 supports opposed cable drums 28 and 30 for rotation therewith, which drums are adapted to wind onto and unwind therefrom elongated flexible cables 32 which depend to and are connected to opposed side edges of the lowermost door section 12*a*, typically adjacent the bottom edge 12*e* by suitable connector means 33, FIG. 2, in a conventional manner known to those skilled in the art.

Cable drums 28 and 30 are provided with constant diameter cable receiving grooves 28*a* and 30*a*, FIG. 2, arranged in a spiral manner side by side and adjacent spiral grooves 28*b* and 30*b* of progressively larger diameter, also configured in a manner known to those skilled in the art. Counterbalance forces are exerted on door 12 by the cables 32 under the influence of opposed torsion coil counterbalance springs 36 and 38, which are sleeved over the shaft 22 and are connected at their opposite ends to spring support devices or cones 40, 42, 44 and 46, FIG. 2. Spring support cones 42 and 44 are suitably mounted stationary and connected to a support bracket 48, which bracket is also mountable on wall 16. Opposite end spring support cones 40 and 46 are clamped to shaft 22 for rotation therewith by a suitable setscrews 49, FIG. 2, but may be loosened so that the torsional windup of the springs 36 and 38 may be adjusted selectively to counterbalance the weight of door 12 in a known manner.

Figure 5:
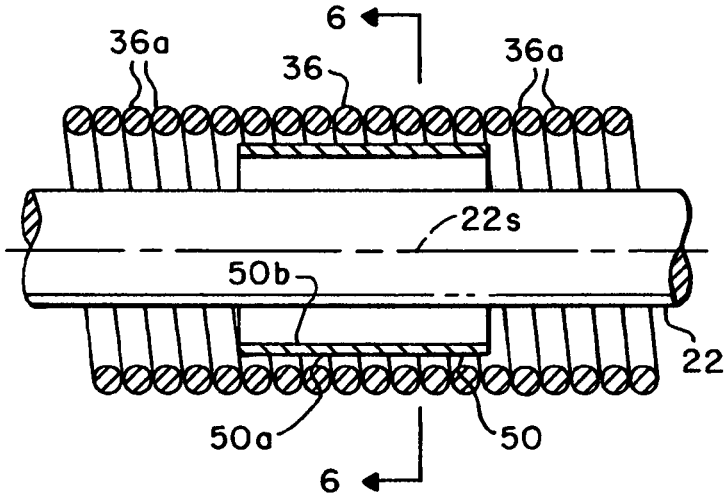
FIG. 5 is a detail longitudinal central section view illustrating a single diameter internal sleeve disposed within one of the torsion springs illustrated in FIG. 2.
Figure 6:
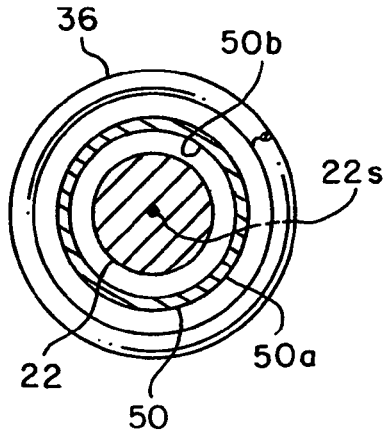
FIG. 6 is a detail cross-section view taken along the line 6-6 of FIG. 5.
Figure 7:
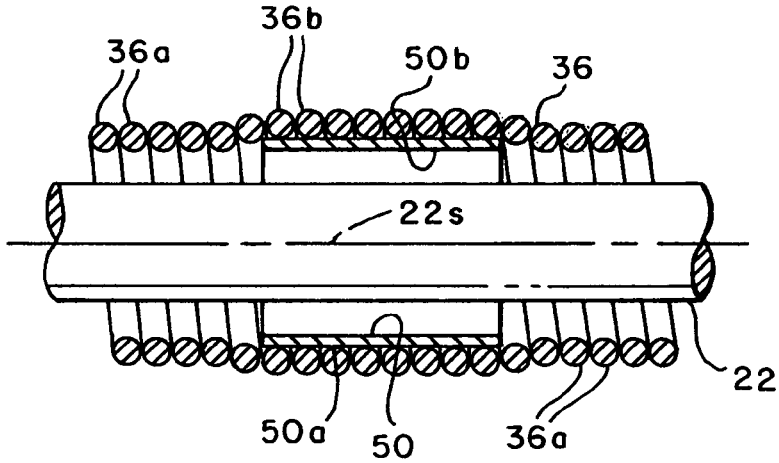
FIG. 7 is a detail section view similar to FIG. 5 but showing the spring coils reduced in diameter and forcibly engaged with the sleeve to modify the effective active length of the spring.

Referring further to FIG. 2 and also FIGS. 5, 6 and 7, the counterbalance system 20 includes at least one cylindrical tubular sleeve 50 disposed over shaft 22 and within each of the springs 36 and 38 and loosely journaled by the springs 36 and 38, as shown by way of example for the spring 36 in FIGS. 5 and 6. Each of the sleeves 50 have an outside diameter 50*a* which, in a generally relaxed state of springs 36 and/or 38 may be only loosely engaged with a selected number of the respective coils 36*a* and 38*a* of the respective springs 36 and 38. A substantially relaxed state of spring 36 is illustrated in FIGS. 5 and 6 and sleeve 50 is shown centered with respect to the shaft 22. The sleeves 50 may rest off-center with respect to the shaft and spring central longitudinal axes 22*s*, which axes may be coincident as shown in the drawing figures.

When the springs 36 and 38 are wound to provide for exerting a torque on the shaft 22, the ends of the springs 36 and 38, secured to the spring supports or cones 42 and 44 are fixed with respect to bracket 48 and wall 16, and a torque is exerted on shaft 22 due to the selective windup of the respective springs. As the springs 36 and 38 are wound the inside diameters of the coils 36*a* and 38*a* are reduced and a number of coils 36*a* and/or 38*a*, see FIG. 7, become forcibly engaged with the sleeve 50, as shown, while other coils remain free to contract or expand. In other words, coils 36*b*, FIG. 7, become effectively inactive since they are forcibly engaged with sleeve 50 and thus, the effective torque or force exerted by spring 36 is modified from that of a conventional torsion coil spring. Moreover, a multi-diameter sleeve or multiple sleeves, such as the sleeve 50, of different outside diameters may be disposed over shaft 22 but within springs 36 and 38, whereby the effective torque and resultant force exerted on the cables 32 for lifting or counterbalancing the door 12 may be further selectively modified. Although two springs 36 and 38 are described for the counterbalance system 20, a single spring or more than two springs may be employed in a counterbalance system in accordance with the invention.

Figure 3:
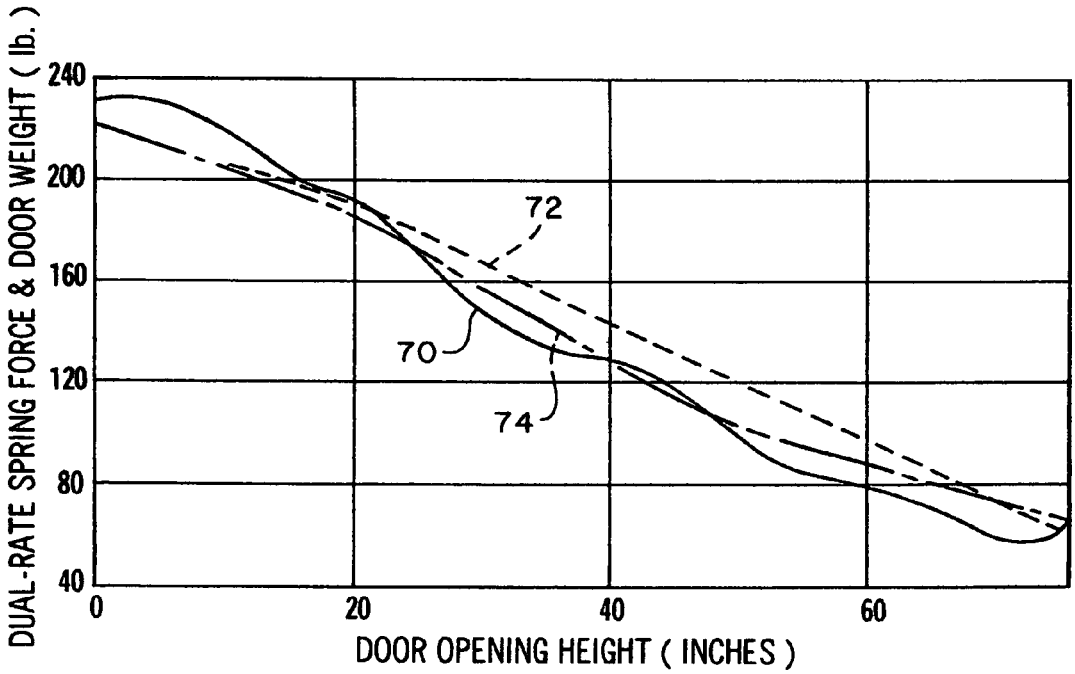
FIG. 3 is a diagram illustrating the effective door weight, spring force of a conventional torsion spring and spring force of a dual or multi-rate torsion spring for respective door opening height positions of the bottom edge of a sectional door.

Referring now to FIG. 3, there is illustrated a diagram of the resultant spring force and door weight in pounds for the position of the door bottom edge, such as the bottom edge 12*e* with respect to floor 17, FIG. 1, and indicated in FIG. 3 as the door opening height in inches. In FIG. 3 the actual door weight or lifting force required for lifting the exemplary door 12 from its closed position (zero opening height) is indicated by the solid line curve 70. The door weight indicated by the curve 70 is for a four section upward acting garage door wherein the uppermost section, such as the section 12*b*, FIG. 1, is significantly heavier than the other three sections 12*a*, respectively. The dash line curve 72 represents the force exerted on the door 12 by a conventional prior art torsion coil spring counterbalance mechanism.

Accordingly, for the first seventeen to eighteen inches of movement of the door 12 from a closed position toward an open position, a positive lifting force is required to be exerted on the door by a motorized operator or by a person attempting to lift the door. However, as noted in FIG. 3, when the door 12 has been lifted to a point about twenty two inches from the floor 17, the lifting force of a conventional torsion spring or springs, as indicated by a curve 72, exceeds the door weight, and significantly at about thirty to thirty-two inches above the floor and again at about fifty inches above the floor. An excess lifting force can cause the door to move rapidly toward an open position which may impose unwanted loads on a motorized operator and may also, if the door is being manually raised, possibly result in injury to the person raising the door or damage to the door since it would tend to move rapidly toward respective stops formed at the ends of the horizontal sections 18*c* and 18*d* of the guide tracks.

However, viewing FIG. 3, the long and short dash curve 74 represents the resultant spring force of counterbalance system 20 acting to counterbalance the weight of the door 12 and the difference between the spring force and the weight of the door, as indicated by comparing the curves 70 and 74 shows a significantly reduced differential between the actual spring force exerted on the door and the weight of the door, thus providing for more consistent counterbalancing forces being exerted on the door as it moves from its closed position (zero inches) to its open position(eighty inches).

Figure 4:
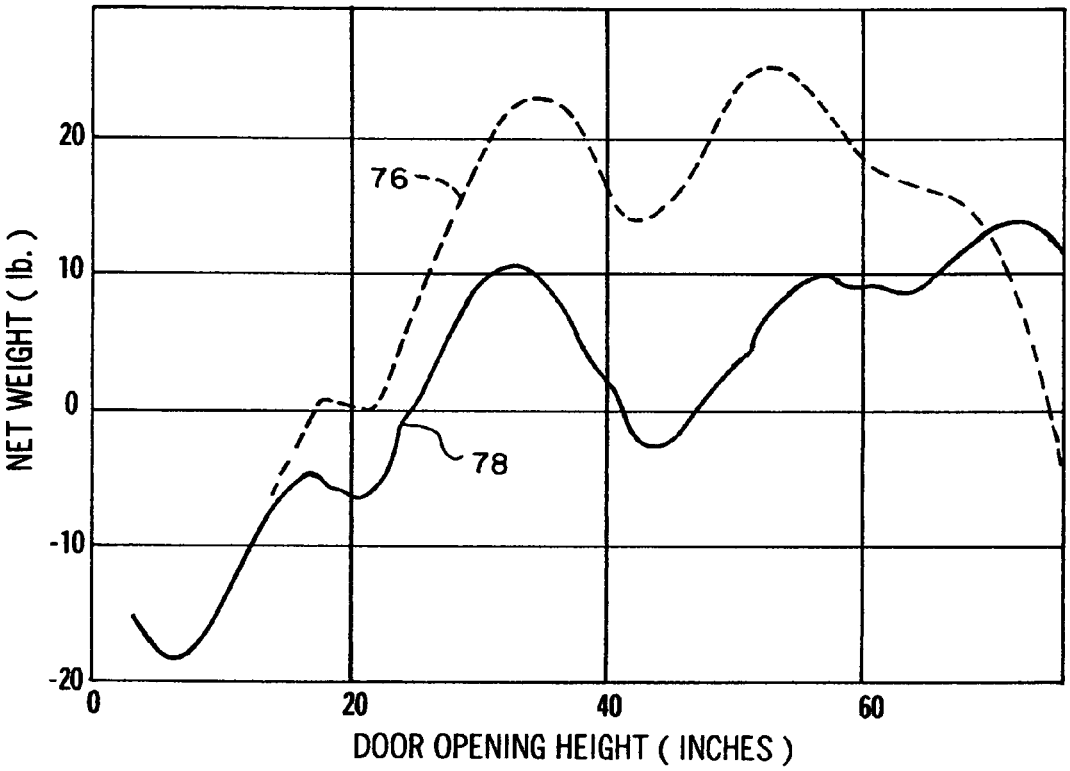
FIG. 4 is a diagram illustrating the net effective weight of a door counterbalanced by a counterbalance mechanism in accordance with the invention as compared with a conventional counterbalance system.

FIG. 4 also illustrates the advantages of the dual or multi-rate counterbalance system 20 of the invention. As shown in FIG. 4, the dashed line curve 76 represents the net weight of the door as it moves from its closed position to its open position without a dual rate counterbalance mechanism. In other words, when the door 12 is in a closed position, an initial force in the range of fifteen to eighteen pounds is required to lift the door and when the bottom edge of the door is at approximately eighteen inches above the floor, it is perfectly counterbalanced. However, as the door bottom edge moves beyond about twenty inches from the floor, a strong upward acting force is exerted on the door until it moves to a substantially open position. As shown in FIG. 4, a second net door weight curve 78 is plotted on the diagram and corresponds to the effective force acting on the door with the counterbalance system 20 according to the invention. As will be appreciated from viewing FIG. 4, the differences in the forces tending to move the door unaided toward the open position is substantial for positions of the door above about eighteen inches from the garage floor. A more uniform and reduced amplitude force curve 78 is provided by the counterbalance system 20 of the present invention as compared with that provided by a single rate torsion spring counterbalance system for a door having a heavy upper section, as indicated by curve 76. As indicated by curve 78 the resultant force tending to move the door unaided toward its open position does not exceed about ten pounds until the door is within about ten inches of its full open position. By comparison, the net opening force acting on the door 12 for a conventional torsion spring counterbalance system results in upward acting forces in excess of twenty-five pounds at a position about fifty to fifty-five inches height of the door bottom edge 12*e* above the garage floor 17.

In FIG. 3, the initial opening travel of the door 12 with the counterbalance system 20 results in the sleeves 50 being engaged with the torsion springs, 36 and 38 against several of the coils of each spring to render the coils inactive. Thus, the spring "active" length is shorter and the spring rate is high. Moreover, the cables 32 are riding or wound on the larger diameter spiral grooves 28*b* and 30*b* of the drums 28 and 30 providing an increased moment or lifting force exerted on the door. In the middle portion of the opening travel of the door 12, the sleeves 50 are still engaged with a pre-determined number of coils of the springs 36 and 38 and the cables are now disposed on the so-called flat or constant diameter portions of the drums 28 and 30, that is, in the cable grooves 28*a* and 30*a* which are of a lesser diameter than the grooves 28*b* and 30*b*. As the cables 32 continue to be wound on the so-called flat portion grooves 28*a* and 30*a* of the drums 28 and 30, the inside diameters of the coils 36*a* and 38*a* of springs 36 and 38 are now tending to grow larger in diameter such that the coils become disengaged from sleeves 50 and are now active. The active length of springs 36 and 38 is now "normal" and the spring rate is lower. However, in the latter part of the travel of the door, the heavy door section 12*b* is now disposed in the horizontal sections 18*c* and 18*d* sections of the guide tracks 18*a* and 18*b*. Accordingly, a properly selected dual rate torsion spring may be provided to closely follow the change in the so-called weight profile of an unbalanced door more closely than a single rate or conventional torsion spring, as indicated from the diagrams of FIGS. 3 and 4.

As mentioned earlier, the sleeves 50 can also be characterized as bushings, cylinders, and the like, and may, in fact, be constructed in a longitudinally split configuration so that they can be more easily mounted on and demounted from a shaft, such as the shaft 22. The external surface or configuration of the sleeves 50 is not necessarily required to be cylindrical as long as the geometry of the sleeve forces the torsion springs to deactivate a certain number of spring coils. Moreover, more than one sleeve 50 of different outside diameters may be used to generate a multi-rate torsion spring, as compared to a dual rate spring described in detail herein.

Figure 8:
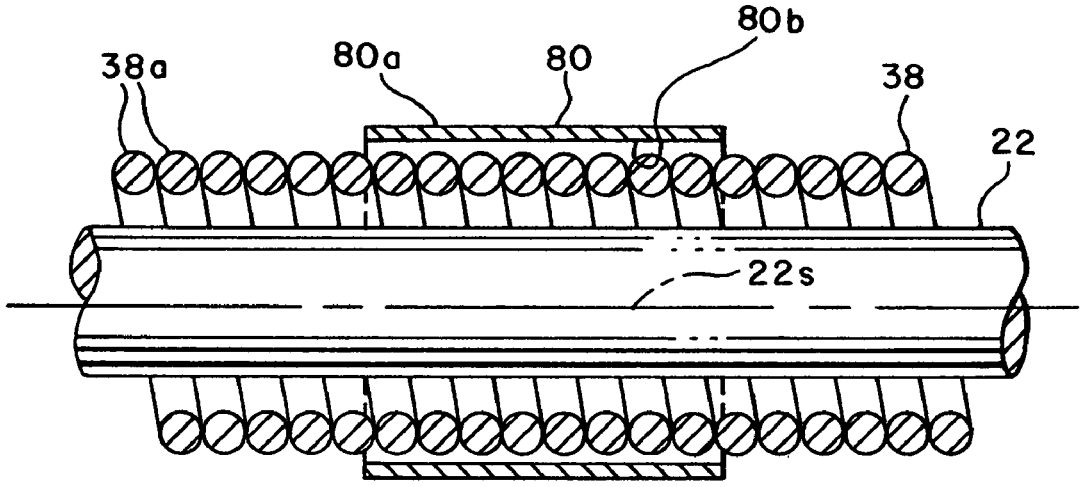
FIG. 8 is a detail section view similar to FIG. 5 but illustrating an external sleeve disposed over a torsion coil spring.
Figure 9:
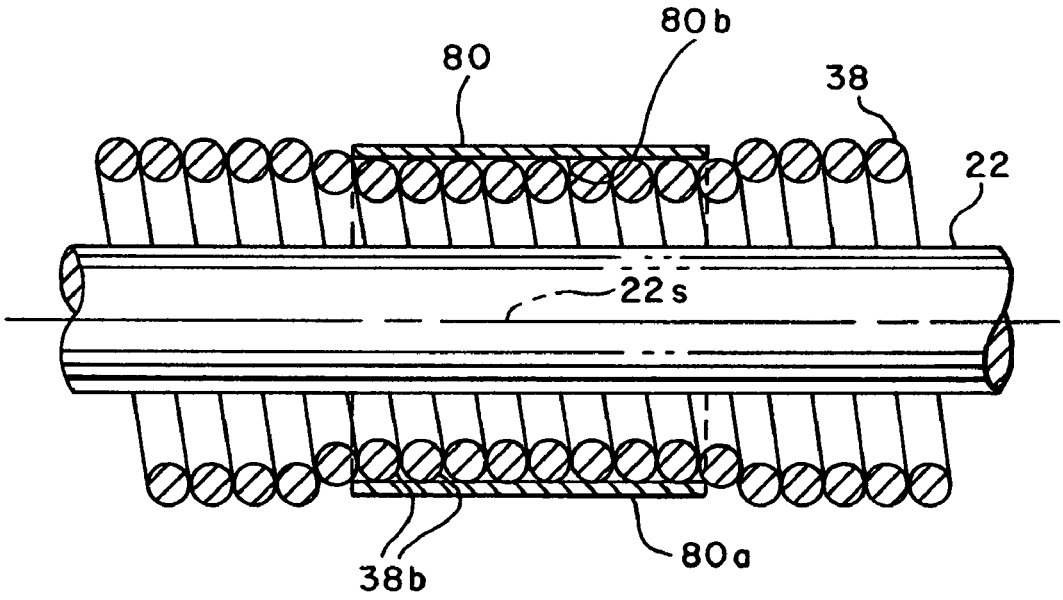
FIG. 9 is a view similar to FIG. 8 showing the external sleeve engaged with several coils of the torsion spring to modify the effective active length of the spring.

As mentioned previously, one or more members, such as tubular sleeves, may also be disposed over the torsion springs 36 and 38. Referring briefly to FIGS. 8 and 9, there is illustrated a portion of the shaft 22 with spring 38 sleeved thereover and a cylindrical sleeve 80 sleeved over the spring and having an outside diameter 80*a* and an inside diameter 80*b*. As shown in FIG. 8, the spring 38 has been wound relatively tightly to reduce the outside diameter of the coils 38*a* so that there is clearance between the sleeve 80 and the spring coils. The sleeve 80 is shown centered with respect to the longitudinal central axis 22*s* of the shaft 22. However, in the tightened or fully wound state of the spring 38*a* and the loose fitting of the sleeve 80 thereover, the sleeve would likely rest on a portion of the outer circumference of several of the coils. The sleeve 80 is also, of course, shorter than the overall active length of the spring 38. However, the inside diameter 80*b* of sleeve is less than the outside diameter of the spring 38 when the coils are partially relaxed or substantially relaxed so that the sleeve 80 engages a predetermined number of coils 38*b*, FIG. 9, to deactivate these coils as the spring 38 begins to unwind and deliver its stored energy. Here again, once the coils 38*b* are inactive, the spring rate changes, thus, a dual rate spring may also be provided by an arrangement of sleeves disposed sleeved over or external to the torsion spring as well as being disposed within or internal to the coil spring. Still further, as mentioned previously, a variable rate torsion spring may be provided by utilizing a conical element or sleeve to generate a variable rate spring force or torque. Conical or multi-diameter sleeves can be installed inside the torsion spring, or sleeved over the torsion spring, or both.

Figure 10:
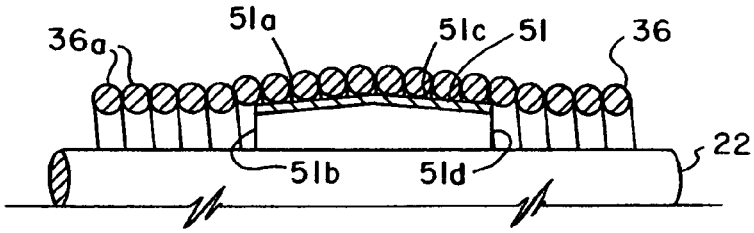
FIG. 10 is a longitudinal half section view similar to FIG. 7 and showing an internal sleeve of variable diameter.

Referring briefly to FIG. 10, there is illustrated a half longitudinal section showing the shaft 22, a portion of coil spring 36 and a sleeve 51 of variable diameter disposed internally of the spring 36. Sleeve 51 has an outside diameter 51*a* which is continuously variable from one end 51*b* to a crown point 51*c* and then is continuously variable from point 51*c* to the opposite end 51*d*. In this way a sleeve, such as the sleeve 51 used in conjunction with coil spring 36 may provide a continuously variable spring rate as the respective coils 36*a* become engaged with and disengaged from the outside diameter 51*a*.

Figure 11:
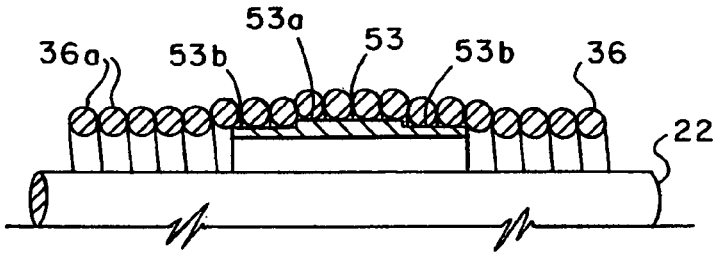
FIG. 11 is a detail section view similar to FIG. 10 and illustrating an internal sleeve with multiple or stepped diameters.

Referring now to FIG. 11, there is illustrated yet another embodiment of a variable rate coil spring arrangement in accordance with the invention wherein a sleeve 53 is illustrated which includes a first outside diameter 53*a* and spaced apart second outside diameters 53*b*. Diameters 53*b* are less than diameter 53*a* and diameters 53*b* may be equal or unequal. Accordingly, a multi rate spring arrangement may be provided with the multi-diameter sleeve configuration illustrated in FIG. 11.

Figure 12:
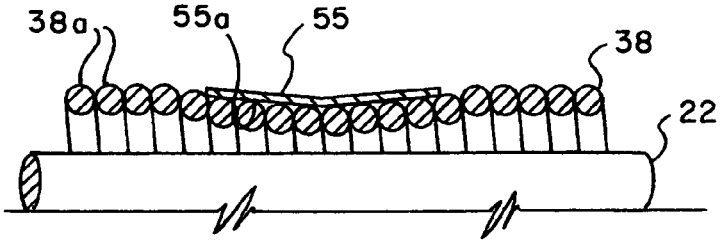
FIG. 12 is a detail half-section view similar to FIG. 9 showing an external sleeve of variable diameter.
Figure 13:
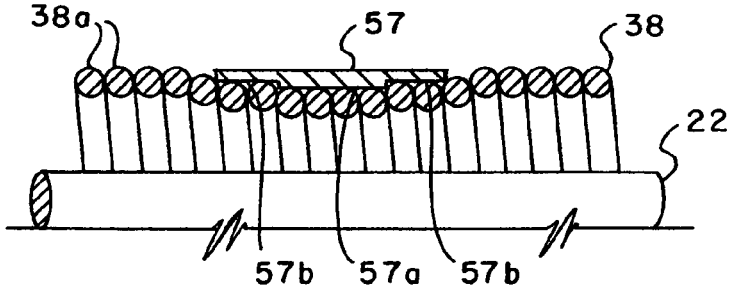
FIG. 13 is a view similar to FIG. 12 but showing an external sleeve having multiple or stepped diameters.

Referring to FIG. 12, there is illustrated an external cylindrical sleeve 55 having a continuously variable inside diameter 55*a* engageable with the coils 38*a* of torsion spring 38. Still further, referring to FIG. 13, there is illustrated still another embodiment of the invention utilizing a generally cylindrical sleeve 57 having a stepped internal diameter wherein diameter 57*a* is less than opposed or spaced apart diameters 57*b* which may be equal to each other or unequal.

Figure 14:
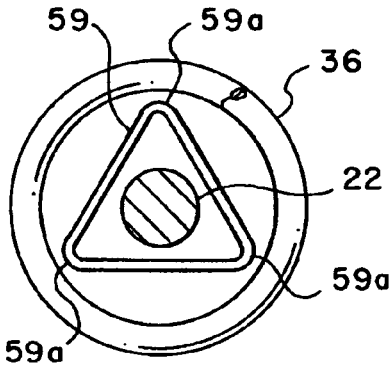
FIG. 14 is a transverse section view illustrating an internal sleeve of non-circular geometry.
Figure 15:
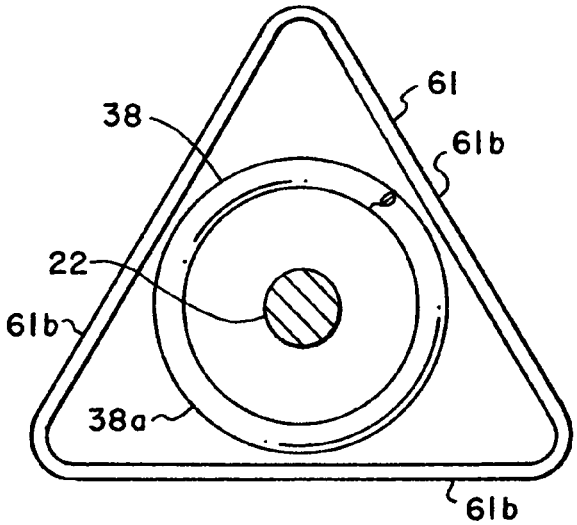
FIG. 15 is a transverse section view illustrating an external sleeve of non-circular geometry.

As mentioned previously, the cross sectional geometry of the sleeve or sleeves may not require to be cylindrical or oval. An internal sleeve 59, FIG. 14, is illustrated disposed within torsion coil spring 36 and sleeved over shaft 22 and having a substantially triangular cross sectional or transverse configuration wherein the apexes 59*a* of the triangular shape of the sleeve are engageable with the coils of spring 36. Still further, as shown in FIG. 15 an external sleeve 61 may be utilized in conjunction with coil spring 38 and also being of non-circular cross section and geometry whereby the substantially linear sides 61*b* of the triangular shape of the sleeve 61 are engageable with the coils 38*a* of spring 38.

Figure 16:
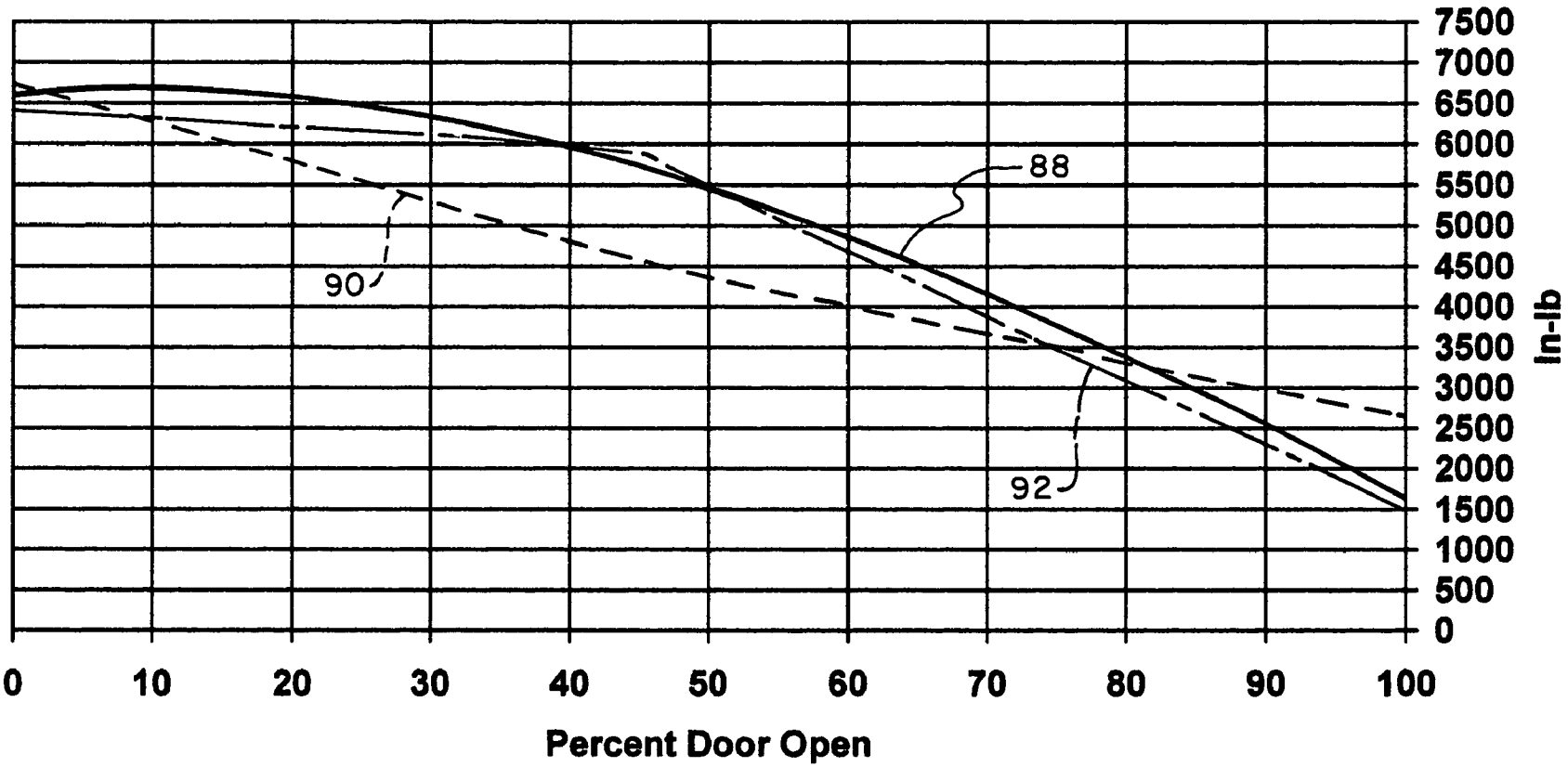
FIG. 16 is a diagram of the torque exerted by a constant rate torsion spring, a dual rate torsion spring and the torque exerted by a rollup type door and showing the improved balance of forces provided by the dual rate spring.

A counterbalance system in accordance with the present invention may also be implemented with so-called rolling or rollup doors, that is, doors which have a flexible curtain like body and are rolled onto themselves about a rotatable drum. Referring to FIG. 16, there is illustrated a typical curve of torque exerted by and on a rollup type door as a percentage of the door open position. For example, referring to solid line curve 88, this curve represents the torque exerted on the door drum support shaft necessary to move the door from its closed position to its open position. Thus, the effective maximum weight of the door is that which essentially required to be lifted when the door begins to move from its closed position (zero percent door open) and which also represents the greatest amount of torque required to be exerted to move the door toward its fully open position (one hundred percent door open).

The torque exerted by a conventional torsion coil spring counterbalance mechanism connected to the drum support shaft of a rollup door is indicated by the dash line curve 90. Curve 90 indicates a relatively constant or linear rate of change in torque as the door is moved from its closed position. As shown in FIG. 10, during the mid-range of movement of the door, the torque exerted by a conventional torsion coil spring is insufficient to counterbalance the weight of the door and may place an undue load on or require a larger motorized operator than would otherwise be necessary. However, if the spring rate of a conventional torsion coil spring would be increased to match the torque required in the mid-range (forty percent to sixty percent door open), the force exerted by a conventional torsion coil spring in the fully closed position of the door would be excessive as well as in the fully open position of the door.

However, with a dual or multi-rate torsion spring counterbalance mechanism in accordance with the invention utilizing an externally disposed sleeve or sleeves, such as sleeve 80, a resultant spring torque force acting on the door would be that according to the curve 92 which more closely parallels or approximates the opposing torque exerted by the door itself. Accordingly, with a counterbalance mechanism in accordance with the invention, the force required to move a rollup type door from a closed position to an open position is substantially reduced and the door does not also have the tendency to open rapidly unassisted as is the case, to some extent, for a conventional counterbalance mechanism, the force or torque characteristics of which are indicated by the curve 90.

Accordingly, by providing a member or members engageable with the torsion coil spring or springs of a door counterbalance mechanism to essentially deactivate a selected number of spring coils during a portion of the winding or unwinding of the spring to exert a lifting force on a vertical opening door, such doors may be more accurately counterbalanced. The invention is particularly useful for doors which have sections or portions thereof of uneven weight, such as sectional doors with upper sections which are heavier than the sections of the rest of the door, for example. For doors with one or more upper sections which are heavier than lower sections or portions the internal sleeve arrangements disclosed herein are used, such as shown in FIGS. 2, 5 through 7, 10, 11 and 14. For doors with lower sections or portions which are heavier than upper sections, and for rollup doors, externally disposed sleeve arrangements are used, such as shown in FIGS. 8, 9, 12, 13 and 15.

The construction and use of a counterbalance system in accordance with the invention is believed to be within the purview of one skilled in the art based on the foregoing description. Although preferred embodiments of the invention have been described in detail, those skilled in the art will also recognize that various substitutions and modifications may be made without departing from the scope and spirit of the appended claims.

What is claimed is:

1. In an upward acting door, a counterbalance mechanism comprising:

an elongated shaft supported generally above said door;

spaced apart cable drums mounted on said shaft for rotation therewith, said cable drums supporting flexible cables depending therefrom and connected to said door respectively;

at least one torsion coil spring having a plurality of coils and being operably connected to said shaft for exerting a torsional effort on said shaft to counterbalance at least a portion of the weight of said door to assist in opening movement of said door, said spring being anchored to a spring support member at an end opposite that connected to said shaft; and at least one sleeve member having an unobstructed central axis, said at least one sleeve member removably disposed between said shaft and at least some of the coils such that said at least one sleeve member is interchangeable with another sleeve member and engageable with the at least some of the coils of said spring, the at least one sleeve member being positioned to allow for reduction of a spring diameter of said spring and to inhibit further reduction of a coil diameter of the at least some of the coils to modify the rate of said spring as said spring is loaded.

2. The invention set forth in claim 1 wherein:

the plurality of coils includes a predetermined number of coils, said at least one sleeve member being engageable with the predetermined number of coils of said spring when said spring is wound to a predetermined number of turns to provide a counterbalance torque exerted on said shaft.

3. The invention set forth in claim 2 wherein:

said at least one sleeve member is generally cylindrical.

4. The invention set forth in claim 2 wherein:

said at least one sleeve member is axially tapered.

5. The invention set forth in claim 2 wherein:

said at least one sleeve member is generally cylindrical and is provided with multiple outside diameters.

6. In an upward acting sectional door having at least one upper section heavier than a bottom section, a counterbalance mechanism comprising:

an elongated shaft supported generally above said door;

spaced apart cable drums mounted on said shaft for rotation therewith, said cable drums supporting flexible cables depending therefrom and connected to said door respectively;

at least one torsion coil spring operably connected at one end thereof to said shaft for exerting a torsional effort on said shaft to counterbalance at least a portion of the weight of said door to assist in opening movement of said door, said spring being anchored to a spring support member at an end opposite that connected to said shaft; and at least one sleeve member having an unobstructed central axis, said at least one sleeve member removably disposed between said shaft and a plurality of coils of said spring such that said at least one sleeve member is interchangeable with another sleeve member and engageable with the plural coils of said spring to allow reduction of a spring diameter of said spring and to inhibit further reduction of a coil diameter of the plural coils to modify the rate of said spring as said spring is loaded whereby said door is at least partially counterbalanced during movement between open and closed positions.

7. The invention set forth in claim 6 wherein:

said at least one sleeve member is generally cylindrical.

8. The invention set forth in claim 6 wherein:

said at least one sleeve member is axially tapered.

9. The invention set forth in claim 6 wherein:

said at least one sleeve member is generally cylindrical and is provided with multiple outside diameters.

10. In an upward acting door, a counterbalance mechanism comprising:

an elongated shaft supported generally above said door;

at least one torsion coil spring operably connected to said door for exerting a torsional effort to counterbalance at least a portion of the weight of said door where said door is moved between open and closed positions, said spring being anchored at one end to a spring support member;

at least one sleeve member having an unobstructed central axis, said at least one sleeve member removably disposed between said shaft and said spring such that said at least one sleeve member is interchangeable with another sleeve member and engageable with plural coils of said spring for allowing reduction of a spring diameter of said spring and inhibiting further reduction of a coil diameter of the plural coils to modify the rate of said spring as said spring is loaded whereby said door is at least partially counterbalanced during movement between open and closed positions.

11. The invention set forth in claim 10 wherein:

said at least one sleeve member includes a sleeve engageable with a predetermined number of coils of said spring when said spring is wound to a predetermined number of turns to provide a counterbalance torque.

12. The invention set forth in claim 11 wherein:

said at least one sleeve member is generally cylindrical.

13. The invention set forth in claim 11 wherein:

said at least one sleeve member is axially tapered.

14. The invention set forth in claim 11 wherein:

said at least one sleeve member is generally cylindrical and is provided with multiple outside diameters.

* * * * *